United States Patent [19]

Talley, Jr. et al.

[11] Patent Number: 4,882,222

[45] Date of Patent: Nov. 21, 1989

[54] CARPET FIBER BLENDS

[75] Inventors: Arthur Talley, Jr., Eva, Ala.; Arnold E. Wilkie, Satellite Beach, Fla.

[73] Assignee: Monsanto Company, St. Louis, Mo.

[21] Appl. No.: 175,790

[22] Filed: Mar. 31, 1988

[51] Int. Cl.[4] ..... D02G 3/00

[52] U.S. Cl. ..... 428/362; 57/246; 57/248; 57/252; 57/253; 57/254; 57/255; 57/256; 428/97; 428/212; 428/360; 428/369

[58] Field of Search ..... 428/97, 212, 362, 360, 428/369; 57/247, 248, 252, 253, 254, 255, 256

[56] References Cited

U.S. PATENT DOCUMENTS

| | | | |
|---|---|---|---|
| 3,330,895 | 7/1963 | Fujita et al. | 264/103 |
| 3,350,872 | 11/1967 | Gorrafa | 57/157 |
| 3,415,051 | 12/1968 | Levesque et al. | 57/140 |
| 3,429,017 | 2/1969 | Holfeld | 28/72 |
| 3,472,017 | 10/1969 | Nakayama et al. | 57/140 |
| 3,587,220 | 6/1971 | Eggleston | 57/140 |
| 3,852,948 | 12/1974 | Ruddell et al. | 57/140 |
| 3,927,167 | 12/1975 | Reese | 264/210 |
| 4,472,481 | 9/1984 | Snooks et al. | 428/362 |

FOREIGN PATENT DOCUMENTS 1102580 2/1968 United Kingdom .

*Primary Examiner*—Marion C. McCamish
*Attorney, Agent, or Firm*—John W. Whisler

[57] ABSTRACT

A blend of conventional carpet fibers (e.g. nylon fibers) and high shrinkage fibers (e.g. acrylic fibers) is described. Saxony carpet made from the blend has better appearance retention characteristics than corresponding saxony carpet made from the conventional carpet fibers.

17 Claims, No Drawings

CARPET FIBER BLENDS

BACKGROUND OF THE INVENTION

This invention relates to a blend of fibers useful, inter alia, for making saxony carpet having better appearance retention characteristics than corresponding carpet made from conventional carpet fibers.

A major portion of residential carpet is a type known as saxony carpet which is a cut-pile carpet having twisted, evenly sheared, medium-length pile yarn, the yarn being in the form of individual short lengths of plied yarn (tufts). Each tuft projects upwardly and terminates as a cut end.

Saxony carpet has a very pleasing initial appearance. The crimp in the individual fibers imparts exceptional cover and loftiness (i.e. firmness, resilience, and body) to the carpet while the ply-twist in the individual tufts gives the carpet a uniform and crisp appearance (i.e. tuft endpoint definition). Unfortunately, most, saxony carpet made from conventional carpet fibers lacks good appearance retention characteristics because the individual tufts of the carpet lose ply-twist when the carpet is subjected to normal traffic. This loss of ply-twist causes tuft ends to open up or "bloom", lose tuft endpoint definition and become entangled with neighboring tuft ends which gives the pile a matted appearance and causes the pile to develop "walkout" in traffic areas. The term "appearance retention" is used to describe the ability of carpet to retain its initial appearance with respect to tuft endpoint definition and lack of matting after being subjected to repeated traffics, where each "traffic" is the occurrence of an individual walking across the carpet.

Efforts in the past to improve the appearance retention characteristics of saxony carpet have not proven entirely satisfactory. For example., while appearance retention can be improved somewhat by inserting more ply-twist in the tufts, doing so also reduces the body of the carpet and provides a carpet having a lean look and a harsh hand, trade-offs the carpet industry is not willing to make and consumers are not willing to accept.

It is apparent, therefore, that a fiber system capable of providing saxony carpets having improved appearance retention and a pleasing appearance and hand would constitute a major contribution to the art.

SUMMARY OF THE INVENTION

The present invention is a blend of fibers comprising carpet fibers and high shrinkage fibers which can be used to provide saxony carpet having improved appearance retention without sacrificing the initial appearance or hand of the carpet. The invention will be understood from the following detailed description of the preferred embodiments.

DETAILED DESCRIPTION OF THE PREFERRED EMBODIMENTS

The fiber blends of the present invention comprise carpet fibers and high shrinkage fibers. (The term "fibers", as used herein, means individual staple fibers or continuous filaments.)

The carpet fibers of the fiber blends are crimped fibers having deniers of at least 10 (dpf) and shrinkage less than 12%. Preferred carpet fibers are nylon 66 fibers, nylon 6 fibers and polyethylene terephthalate (PET) fibers. Other suitable carpet fibers include polyolefin fibers, such as polypropylene fibers, as well as other nylon and polyester fibers, such as nylon 612 fibers or polybutylene terephthalate fibers. Preferably, the carpet fibers have shrinkages of less than 8% and most preferably less than 5% and deniers of at least 12, usually between 5 and 25; a crimp frequency between 5 and 16 crimps per inch (2 to 6 crimps per cm), most preferably between 8 and 14 crimps per inch (3 to 6 crimps per cm), and a nonround cross-section (e.g. trilobal cross-section). If desired, mixtures of carpet fibers of different polymer composition (e.g. a nylon 66 and PET fiber mix) or a mixture of carpet fibers differing only or as well in shrinkage, denier, crimp or other characteristics may be used in the blend.

The high shrinkage fibers of the fiber blends have shrinkages of at least 12%. The high shrinkage fibers may be crimped or uncrimped and may be of a round or nonround cross-section. The denier of the high shrinkage fibers may be the same as or different from the denier of the carpet fibers of the blend. Preferred high shrinkage fibers will have shrinkages at least 10 shrinkage units higher than the shrinkages of the carpet fibers and most preferably at least 20 shrinkage units higher. Suitable fibers which are available in the requisite shrinkage range include, but are not limited to; polyester fibers (e.g. PET fibers); nylon copolymeric fibers, such as the copolymer consisting of hexamethylene adipamide (66) units, hexamethylene terephthalamide (6TA) units and hexamethylene azelamide (69) units where the amounts of 6TA and 69 units are selected to provide a copolymer having a melting point approximating that of the carpet fibers of the blend; and acrylic fibers. By acrylic fibers is meant fibers spun from a fiber-forming synthetic polymer composed of at least 85% by weight of acrylonitrile units and fibers (modacrylic fibers) in which the fiber-forming polymer is composed of less than 85% but at least 35% by weight of acrylonitrile units. Conventionally, the fiber-forming polymer is a copolymer of acrylonitrile with one or more vinyl compounds, such as: vinyl acetate, vinylpyridine, methylvinyl-pyridine, methyl methacrylate, vinyl chloride, vinyl bromide, and/or vinylidene chloride. Particularly preferred high shrinkage fibers for use in providing the blends of the present invention are acrylic fibers and PET fibers having shrinkages in the range of 20% to 35%. If desired, mixtures of high shrinkage fibers of different polymer composition and/or different shrinkages or other characteristics may be used in the blends (e.g. a mixture of acrylic and polyester high shrinkage fibers).

Preferably, the blend consists of staple fibers because blends of staple fibers, as compared to blends of continuous filaments, are easier to make and offer greater flexibility with respect to varying the proportions of the carpet fibers and high shrinkage fibers, intimate blending thereof and incorporation of additional fiber components. Usually, saxony carpet staple fibers are cut to a definite length, i.e. a length between 6 and 9 inches (15 to 23 centimeters) from a tow of substantially identical filaments to provide staple fibers which are of the same composition (e.g. nylon 66) and have the same denier, crimp frequency, cross-sectional shape and length. If desired, the carpet fibers of the blend may consist of a mixture (blend) of carpet staple fibers having, for example, different cross-sectional shapes and/or different deniers and/or different lengths and/or different polymer composition (e.g. nylon and PET) for the purpose of providing, for example, special dyeing effects or to improve the economics and/or luster and/or body of the carpet. The high shrinkage fibers of the staple blend preferably are cut to the same length as the carpet fibers of the blend.

The quantities and shrinkages of the carpet fibers and high shrinkage fibers are selected such that at 40,000 traffics the appearance of test carpet having a pile consisting of the blend (and prepared as hereinafter described) is better (as determined by Test A, hereinafter described) with respect to tuft endpoint definition and lack of matting than corresponding test carpet having a pile consisting solely of the carpet fibers. Preferably, the difference in appearance between the test carpets after 40,000 traffics is at least 1 ASTM grade and most preferably at least 2 ASTM grades (as determined by Test B, hereinafter described). Typically, the weight ratio of carpet fibers to high shrinkage fibers present in the blend will be in the range of 60:40 to 95:5 and, preferably, is in the range of 80:20 to 90:10. In the case of nylon/acrylic blends, for example, if the blend contains less than about 5% by weight of the high shrinkage fibers, the effect thereof on appearance retention of saxony carpet becomes marginal and, if the blend contains more than about 40% by weight of the high shrinkage fibers, the saxony carpet tends to lose its pleasing initial appearance. Particularly good results are obtained with blends consisting essentially of nylon 66 staple carpet fibers and high shrinkage acrylic staple fibers in a weight ratio ranging from 80:20 to 90:10.

The blend may contain in addition to carpet fibers and high shrinkage fibers other fibers so long as the blend provides the above-mentioned appearance retention characteristics. For example, the blend may contain fibers made from wool, cotton, metal, carbon, etc. or fibers that contain additives such as carbon black. It is also contemplated that all or a portion of fibers of the blends may be coated with materials such as fluorocarbons and/or stain blockers for the purpose of improving the soil and stain resistance of the fibers.

High shrinkage fibers useful for providing the blends of the present invention may be prepared by conventional techniques. For example, high shrinkage acrylic staple fibers useful for preparing the fiber blends of the invention may be obtained from acrylic tow having the desired shrinkage characteristics. In general, the more the tow is hot stretched, the greater is its shrinkage. The hot-stretching of the tow may be accomplished in a conventional manner either prior to cutting of the tow to staple or as a part of a stretch-break process. Typically, if the tow is hot-stretched 1.6 to 2.0 times its length, shrinkage of the tow will be in the range of 20 to 40%. High shrinkage PET fibers can be provided by known techniques selected to provide the desired shrinkages. The resulting yarns can be used in filament form or converted to staple of an appropriate length by conventional techniques.

The polymer composition of the fibers of the blend is selected to permit processing of the fibers into yarns and carpets, bearing in mind, temperatures, stresses, etc., generally encountered.

In using the fiber blends of this invention, the shrinkage of the high shrinkage fibers must be preserved until carpet yarns made from the blends are prebulked and/or heatset. Thus, it may be necessary to either cold crimp rather than hot crimp the high shrinkage fibers or to not crimp the high shrinkage fibers at all. In the case of continuous filament blends, the blend can be formed by, first, steam-jet texturing a yarn consisting of the carpet filaments and, then, inserting high shrinkage filaments into the yarn (e.g. by means of an air tangling jet) and, finally, winding the resulting yarn consisting of the fiber blend on a bobbin.

MEASUREMENTS/TESTS

I. Shrinkage: the term "shrinkage", as used herein with reference to fibers, is determined by the following test: A sample of the fiber is placed under a tension of 0.100 grams per denier to fully extend the fiber (straighten out any crimp) without stretching or elongating the fiber. The length of the fiber in this condition is measured and recorded as $L_o$. The fiber is then immersed in boiling water for ten minutes under no tension, removed and allowed to cool and dry for 10 minutes under no tension, and then under a tension of 0.100 grams per denier, its length is again measured This latter measured length is recorded as $L_1$. Shrinkage is then determined by the following formula: % Shrinkage$=[(L_o-L_1)/L_o]\times 100$ or $(L_o-L_1/L_o)\times 100=$shrinkage units. .

II. Appearance retention: the following tests (Test A and Test B) given in this section provide a means by which a blend of carpet fibers and high shrinkage fibers can e compared to the carpet fibers of the blend with respect to their ability to impart appearance retention characteristics to saxony carpet.

In the case of staple fibers, test carpets are made as follows:

(1) The blend of carpet fibers and high shrinkage staple fibers is converted to 65 grain sliver and spun on a conventional Whiten NW long staple carpet ring spinning frame (or on an equivalent frame) to provide 3.50 cotton count (cc) singles yarn having 5.0 tpi of twist in the Z-direction. Two of these yarns are then twisted together on a ply twister with 4.3 tpi of twist in the S-direction to provide Blend test yarn. A second test yarn (Control test yarn) is made in exactly the same manner except in this instance the high shrinkage fibers of the blend are replaced with a corresponding weight of the carpet fibers.

(2) the test yarns are heatset in a conventional manner under conditions that are suitable for the carpet fibers of the yarn and that minimize restriction of the shrinkages of any of the fibers of the yarn.

(3) Two cut-pile carpet samples of saxony construction (test carpets) are made. One of the test carpets (Control) is made using the Control test yarn and the other test carpet (Blend) is made using the Blend test yarn. Both test carpets are made using the following construction:

(a) gauge (spacing between rows of tufts) — 5/32 inches.

(b) tuft height—⅝ inches.

(c) face weight—30 ounces of yarn per square yard of carpet with the spacings between stitches being selected to provide the 30 ounce face weight.

(d) backings—the primary backing is a polypropylene backing, such as Polybac® backing (style 2477) and the secondary backing is also a polypropylene backing, such as Actionbac® backing (style 3801).

(4) The test carpets are dyed using conventional beck dyeing equipment and the following procedure:

(a) load carpet over reel and set carpet speed at 60 ypm, (b) set dyebath at 27° C. with a 30:1 liquor to goods ratio, (c) conventional anti-foaming agents, leveling agents, pH buffers, sequestering agents and anti-coagulants are added as needed, (d) raise temperature to 38° C. at the rate of 1.5° C. per minute and run for 10 minutes at 38° C., (e) add a sufficient amount of an appropriate dye-stuff to dye the test carpets to a light shade of color (addition of dye-stuff is omitted where the carpet fibers of the blend are already dyed, i.e., predyed fibers), (f) raise temperature to 97° C. at the rate of 1.5° C. per minute, (g) run at 97° C. for 60 minutes.

(h) flood rinse to 71° C., run 5 minutes, drop bath and cold rinse, (i) dry and then laminate carpet at 121° C. carpet face temperature.

(5) A sample of each test carpet (Blend and Control) is subjected to 40,000 traffics using the procedure described in ASTM Designation D2401. (The carpet samples are placed directly on the floor—a pad is not used.)

(6) Test A—The trafficked test carpet samples (Blend and Control) are visually compared in a side-by-side comparison without knowledge of which test carpet is which and the carpet having the better appearance with respect to tuft endpoint definition and lack of matting is identified. (Color appearance is not taken into consideration.) Test A given in this paragraph provides a simple means for determining which of two carpets has better appearance retention characteristics.

(7) Test B—The difference in appearance between the trafficked Blend test carpet and Control test carpet is determined by evaluating the appearance retention of both test carpets using six (6) graders and reference photographs in the manner described in ASTM D2401. Each grader determines an ASTM grade for both test carpets. For each grader the Blend test carpet grade is subtracted from the Control test carpet grade and the differences expressed in terms of ASTM Grades, are averaged. If the averaged differences is positive, the Blend test carpet has better appearance retention characteristics and, if the averaged differences is negative, the Control test carpet has better appearance retention characteristic. Test B given in this paragraph provides a means for quantitatively assessing the difference in appearance retention characteristics between two or more carpets.

In the case of continuous filament yarn, Test A and B are performed as just described except that the continuous filament plied Blend and Control test yarns are made as follows: Two ends of a continuous filament singles yarn consisting of a blend of carpet fibers (filaments) and high shrinkage fibers (filaments) are cabled with 3.5 tpi of twist to form a plied Blend test yarn. A second plied test yarn (Control test yarn) is made in exactly the same manner except in this instance the high shrinkage filaments of each of the two ends of the singles yarn are replaced with a corresponding weight of the carpet filaments prior to cabling of the two yarns. The plied test yarns are then heatset, made into test carpets, dyed and tested as described above.

EXAMPLE

This example illustrates preparation of carpet fiber/-high shrinkage fiber blends of the invention and the improved appearance retention characteristics of saxony carpet made therefrom. The following fibers are obtained:

(1) Conventional crimped nylon 66 carpet staple fibers which are uniform in appearance and have a length of 7½ inches (19.05 cm), a denier of 19, an average of 12 crimps per inch (4.72 crimps per cm), a shrinkage of about 3% and a trilobal cross-section;

(2) Conventional crimped PET carpet staple fibers having a shrinkage of <1%, a length of 7 inches, a denier of 15, an average of 9 crimps per inch and a trilobal cross-section;

(3) Acrylic staple fibers consisting of a copolymer of acrylonitrile and vinyl acetate in a weight ratio of about 93:7 and having a length of 7½ inch (19.05 cm), a denier of 12 and a shrinkage of about 28%;

(4) PET staple fibers having a length of 7½ inches (19.05 cm), a denier per filament of 12 and a shrinkage of about 21%; PET staple fibers having a length of 7½ inches (19.05 cm), a denier of 12 and a shrinkage of about 41%; PET staple fibers having a length of 7½ inches (19.05 cm), a denier of 12 and a shrinkage of about 53%.

(5) Nylon staple fibers consisting of a copolymer (COP) of 66 units, 69 units and 6TA units in a weight ratio of 50/25/25 and having a shrinkage of about 17%, a length of 7½ inches (19.05 cm) and a denier of 12.

Test carpets dyed to a light mauve shade of color are made as described using the above fibers and blends thereof shown in Table I.

TABLE 1

| | | | High Shrinkage Fiber (Shrinkage) | | | |
|---|---|---|---|---|---|---|
| Carpet | Carpet Fiber | Acrylic (28%) | PET (21%) | PET (41%) | PET (53%) | COP (17%) |
| A | Nylon 66 | | (Control)* | | | |
| B | Nylon 66 | 90/10** | | | | |
| C | Nylon 66 | 80/20 | | | | |
| D | Nylon 66 | 70/30 | | | | |
| E | Nylon 66 | | | | | 80/20 |
| F | PET | (Control) | | | | |
| G | PET | | 80/20 | | | |
| H | PET | | | 80/20 | | |
| I | PET | | | | 80/20 | |
| J | PET | 90/10 | | | | |
| K | PET | 80/20 | | | | |
| L | PET | 70/30 | | | | |
| M | Nylon/ PET (50/50) | | 80/20 | | | |

*(control) means 100% Carpet Fiber
**ratio, by weight, of carpet fiber/high shrinkage fiber.

Each test carpet shown in Table I is subjected to 40,000 traffics as described herein and then the following pairs of test carpets are compared by Test A to determine which test carpet of each pair has the best appearance with respect to tuft endpoint definition and lack of matting: A/B, A/C, A/D, A/E, F/G, F/H, F/I, F/J, F/K, F/L, A/M and F/M. In each instance the Blend Test Carpet is selected as having better appearance than the corresponding Control Test Carpet (A or F).

The difference in appearance retention (using 6 graders) between the Blend and Control Test Carpets is determined using Test B. The difference in appearance retention between most of the above pairs of Blend Test Carpets and Control Test Carpets is at least 1 ASTM Grade and in many cases is at least 2 ASTM Grades.

Similar results can be expected by using a blend of carpet fibers and high shrinkages fibers in continuous filament form, for example, by using a yarn consisting of continuous filaments of nylon 66 as the carpet fiber component of the yarn and continuous filaments of high shrinkage filaments as the high shrinkage component of the yarn.

Saxony carpets made using blends of the present invention instead of conventional carpet fibers have a very pleasing initial appearance, in fact, the initial appearance thereof is as good as and in many instances superior to that of saxony carpets made from conventional carpet fibers. Conventionally, saxony carpet is not made using yarns consisting solely of high shrinkage fibers because saxony carpet made from such yarns has an unacceptable board-like appearance and hand and, in the case of high shrinkage acrylic fibers, also lacks loftiness and has a matted appearance. Acrylic fibers, including low shrinkage acrylic fibers, are not commercially used in the construction of saxony carpets since during the hot-wet dyeing operations conventionally used acrylic fibers lose their crimp (i.e. they "lean out") and their ability to stand erect (i.e. they lean over and mat down). Thus, it is truly surprising that the appearance retention characteristics of saxony carpet can be greatly improved by using fibers which by themselves provide carpet having poor appearance characteristics.

Although blends of carpet fibers of different compositions, cross-sections and/or deniers have been used in the past to improve carpet properties, such as loftiness, luster, sparkle, cover and abrasion resistance, such blends do not improve the appearance retention of carpet.

The fiber blends of the invention, in addition to being used to improve the appearance retention of saxony carpet, may also be used in other carpet constructions and for other uses such as to produce upholstery fabric. The fiber blends of the invention are typically either blends of staple fibers or blends of continuous filaments. However, the blends may also be blends of staple fibers and continuous filament(s), for example wrap spun yarns consisting of carpet staple fibers wrapped with a high shrinkage continuous filament or filaments or wrap spun yarns consisting of carpet fibers and high shrinkage fibers wrapped with a continuous filament or filaments of a conventional shrinkage, for example, convention carpet filaments.

We claim:

1. A blend of fibers comprising carpet fibers and high shrinkage fibers, the carpet fibers being crimped fibers having deniers of at least 10 (dpf) and shrinkages of less than 12%, the high shrinkage fibers being fibers having shrinkages of at least 12%, the quantities and shrinkages of said carpet fibers and said high shrinkage fibers being such that when a saxony test carpet having a pile made from heatset yarn which prior to being heatset consists of said blend of fibers is subject to 40,000 traffics, the appearance thereof is better with respect to tuft endpoint definition and lack of matting, as determined by Test A, than corresponding test carpet having a pile made from heatset yarn which prior to being heatset consists entirely of said carpet fibers.

2. The blend of claim 1 wherein the fibers of said blend are staple fibers.

3. The blend of claim 2 wherein said carpet fibers are nylon fibers or polyester fibers or blends thereof.

4. The blend of claim 3 wherein said high shrinkage fibers are acrylic fibers or polyester fibers.

5. The blend of claim 2 wherein said carpet fibers are nylon fibers and said high shrinkage fibers are acrylic fibers.

6. The blend of claim 1 wherein said carpet fibers and said high shrinkage fibers are continuous filaments in the form of a singles yarn.

7. The blend of claim 6 wherein the carpet filaments consist essentially of nylon filaments.

8. The blend of claim 7 wherein the high shrinkage filaments consist essentially of polyester filaments or nylon copolymeric filaments.

9. The blend of claim 1 wherein the difference in shrinkages between said carpet fibers and said high shrinkage fibers is at least 10 shrinkage units.

10. The blend of claim 1 further characterized in that the difference in appearance between said test carpets is at least 1 ASTM Grade, as determined by Test B.

11. The blend of claim 1 further characterized in that the difference in appearance between said test carpets is at least 2 ASTM Grades, as determined by Test B.

12. A blend of staple fibers having an average length in the range of 6 to 9 inches (15 to 23 centimeters) and consisting essentially of crimped carpet staple fibers and high shrinkage staple fibers in a weight ratio ranging from 60:40 to 95:5, carpet staple fibers to high shrinkage staple fibers, said carpet staple fibers being selected from the group consisting of nylon staple fibers, polyester staple fibers and mixtures thereof and having shrinkages less than 8%, deniers of at least 12 and a crimp frequency in the range of 5 to 17 crimps per inch (2 to 6 crimps per cm), said high shrinkage staple fibers being staple fibers having shrinkages of at least 12% and at least 10 shrinkage units higher than the shrinkages of said carpet staple fibers.

13. The blend of claim 12 further characterized in that the quantities and shrinkages of said carpet fibers and said high shrinkage fibers are such that when a saxony test carpet having a pile made from heatset yarn which prior to being heatset consists of said blend of fibers, the appearance thereof is better with respect to tuft endpoint definition of lack of matting, as determined by Test A, than corresponding test carpet having a pile made from heatset yarn which prior to being heatset consists entirely of said carpet fiber.

14. The blend of claim 13 further characterized in that the difference in appearance between said test carpets is at least 1 ASTM Grade, as determined by Test B.

15. The blend of claim 13 further characterized in that the difference in appearance between said test carpets is at least 2 ASTM Grades, as determined by Test B.

16. The staple blend of claim 12 wherein said high shrinkage fibers consist essentially of acrylic staple fibers.

17. The blend of claim 16 wherein said carpet fibers are nylon 66 fibers.

* * * * *